US005826281A

United States Patent [19]

Rush, III

[11] Patent Number: 5,826,281

[45] Date of Patent: Oct. 27, 1998

[54] INFLATABLE CHIN STRAP FOR A HELMET

[76] Inventor: Gus A. Rush, III, 1800 12th St., Meridian, Miss. 39301

[21] Appl. No.: 743,029

[22] Filed: Nov. 4, 1996

[51] Int. Cl.[6] ..... A42B 3/08

[52] U.S. Cl. ..... 2/421; 2/413

[58] Field of Search ..... 2/413, 421, 425, 2/410, 411

[56] References Cited

U.S. PATENT DOCUMENTS

| | | | |
|---|---|---|---|
| 600,778 | 3/1898 | Frazier | 2/413 |
| 3,462,763 | 8/1969 | Schneider et al. | 2/413 |

FOREIGN PATENT DOCUMENTS

| | | | |
|---|---|---|---|
| 2726595 | 12/1978 | Germany | 2/413 |
| 568033 | 10/1975 | Switzerland | 2/413 |

*Primary Examiner*—Michael A. Neas

*Attorney, Agent, or Firm*—Cushman Darby Cushman Intellectual Property Group of Pillsbury Madison & Sutro LLP

[57] ABSTRACT

A protective chin strap for headwear such as an athletic helmet is provided with a chin portion including an inflatable pouch and a manually operated valve pump so that the wearer can inflate the pouch to adjust the tension of the strap to adjust the force holding the helmet on the head of the wearer as well as at the same time provide a shock absorbing cushion on the chin of the user.

2 Claims, 2 Drawing Sheets

INFLATABLE CHIN STRAP FOR A HELMET

FIELD OF THE INVENTION

The present invention relates to an improved chin strap for use with an athletic helmet and to a helmet provided with such a strap. More particularly, the chin strap of the present invention includes an easily and controllably inflatable pouch that fits over the chin of the wearer of the strap so that the degree of inflation will provide control over the tension in the strap holding the helmet in position on the head of the user.

BACKGROUND OF THE INVENTION

In the athletic and other fields where protective helmets are worn, a number of alternatives have been proposed for increasing the safety of the wearer against blows to the head as a result of collisions, or other physical impacts experienced during either a racing or athletic event such as frequently occurs in football, rugby and similar sports. One alternative has involved using an inflatable lining for the helmet. This alternative, while generally successful in providing increased protection, has not gained widespread acceptance for a number of reasons. Chief among these is the lack of comfort for the wearer particularly in warm and humid weather when most outdoor athletic events take place. In addition, the expense of manufacturing and maintaining such helmets with inflatable liners has also adversely affected their acceptance. As an alternative, which is less expensive, manufacturers have employed resiliently stretchable straps to fit over the chin of a wearer and between the depending ear lobe protecting walls of the helmet. Again, while providing increased comfort compared to that provided by an inflatable liner, the stretchable chin strap has not appreciably increased the protection desired for many driving and athletic events.

SUMMARY OF THE INVENTION

The present invention provides a chin strap for an athletic helmet and a helmet is provided which will afford much greater comfort at lower expense than the structures of the prior art.

In a preferred embodiment, the chin strap of the present invention, in one form, will include two conventional strap members which may be made of woven polypropylene, nylon or similar durable fabric. Each will have one end securely attached such as by stitching or clipping to a surface of the helmet. The opposite end of each strap will have an attachment buckle to secure that end of the strap to one end of an inflatable pouch. The pouch will be in communication with a manually operable valved pump which can be actuated by a user to inflate the pouch with air while the strap is in position on the helmet and extending over the chin of the user. With this arrangement, tightening of the strap by the inflation can be effected to a degree that is comfortable for the user.

The foregoing and other advantages will become apparent as consideration is given to the following detailed description taken in conjunction with the accompanying drawings:

DETAILED DESCRIPTION OF THE INVENTION

Figure 1:
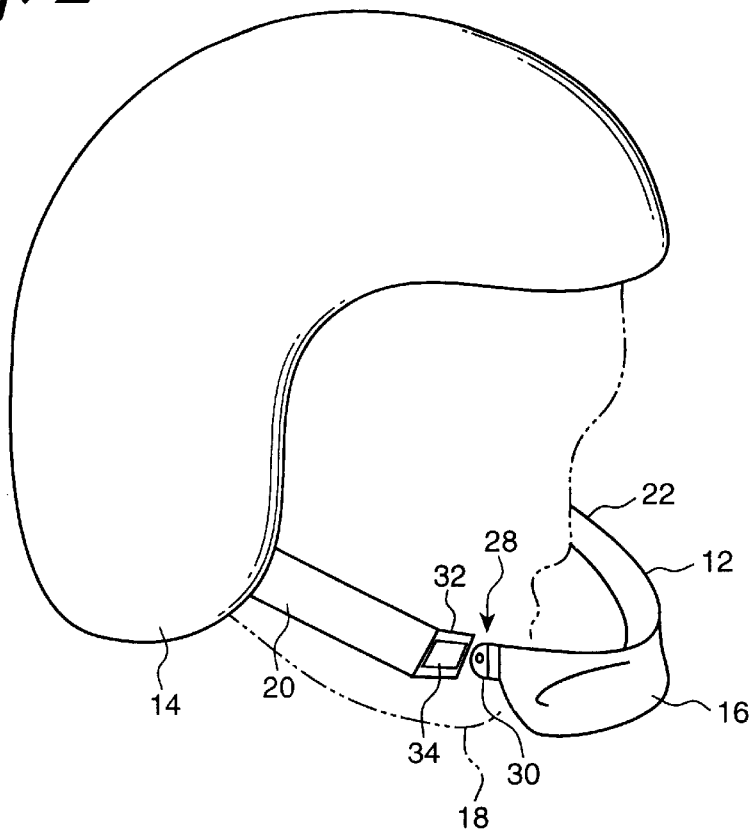
FIG. 1 is a perspective view showing a helmet including the strap of the present invention positioned about the chin of a user.

Referring now to the drawings wherein like numerals designate corresponding parts throughout the several uses, there is shown in FIG. 1 a helmet 10, which may be a football or cycling helmet on the head of a wearer with the strap 12 of the present invention extending generally from one earlobe protecting wall 14 to the opposite wall (not shown) on the other side of the head of the wearer.

As is conventional, the helmet 10 may be of the high impact plastic such as a polycarbonate type although other types may be employed including metal. Typically, such helmets have a cushioned lining to provide some shock absorbing ability to the helmet when worn by a person. In order to make use of this feature, it is necessary that the helmet 10 be securely positioned on the head of a user and to this end, the strap 12 of the present invention is provided with an inflatable air cushion or pouch 16 which is positioned intermediate the opposite ends of the strap 12 so as to be positioned astride the chin 18 of a user.

In a preferred embodiment, the strap 12 will include two strap sections 20 and 22, each of which has one end securely mounted in a suitable manner to the earlobe wall 14 of the helmet. Typically, such attachment may be in the form of stitching, riveting, or adhesive securement. In this connection, the strap portions 20 and 22 may be made from woven polypropylene, polyester or nylon filaments to provide the required strength to the strap 12. The pouch 16 in this embodiment will be provided with oppositely extending tabs 24 and 26 which may be releasably attachable to the associated end of the strap sections 20 and 22. In this regard, a male/female clip such as illustrated at 28 in FIG. 1 may be employed where a tongue 30 is inserted into a socket 32 to be resiliently held by flexible detents such as at 34 as will be apparent to those skilled in this art. The same type of connection may be employed for the tab 24 on the opposite end of the pouch 16.

As an alternate embodiment, the tab 24 of the pouch 16 may be formed integrally with the strap portion 22 so that the single connection between the strap is at the connection 28. In this embodiment, the strap portions 20 and 22 would be permanently attached to the interior or exterior of the ear protecting wall 14.

Figure 2:
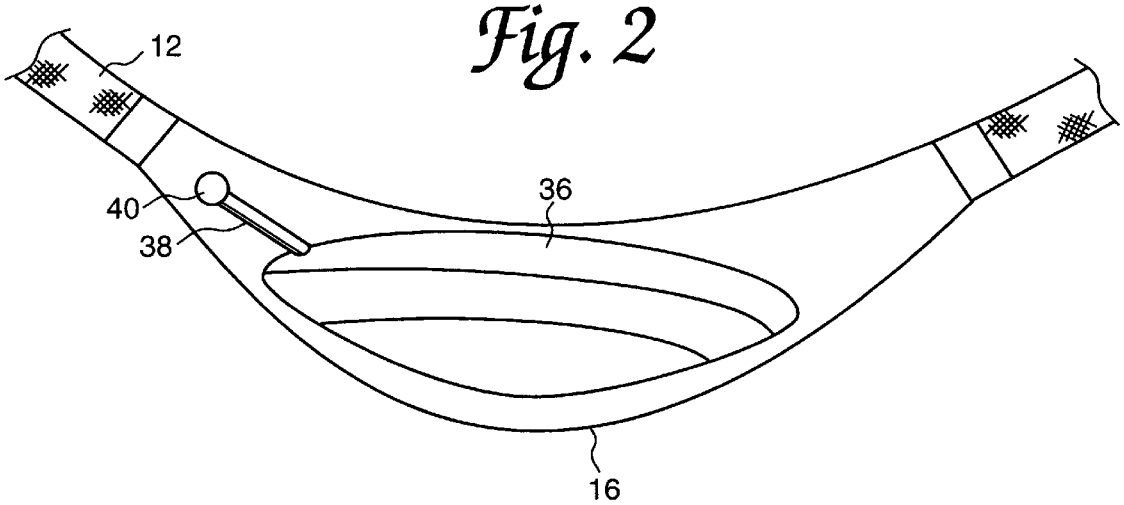
FIG. 2 is a top plan sectional view of a portion of the strap of the present invention.
Figure 3:
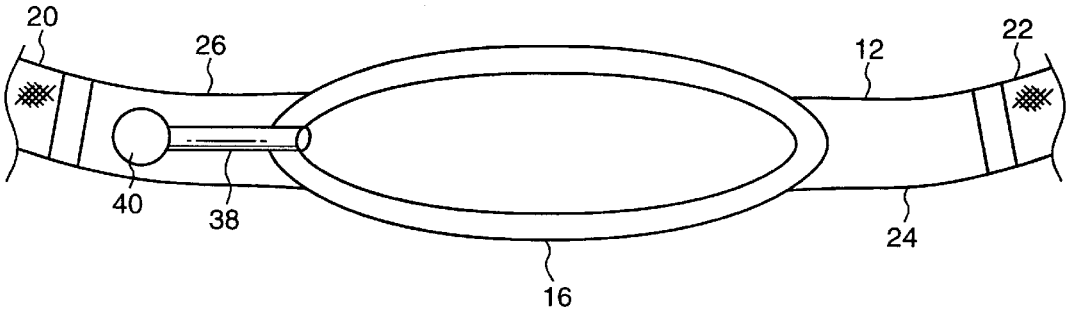
FIG. 3 is a front elevational view partly in section of the strap of FIG. 2.

Turning now to FIGS. 2 and 3, it will be seen that the pouch 16 includes an outer skin 36 of flexbile material such as rubber or neoprene. In the illustrated embodiment, the tabs 24 and 26 on opposite sides of the oblong pouch 16 may be made of the same material as the strap sections 20 and 22 in order to give better resistance to stretching by the strap 12.

Figure 4:
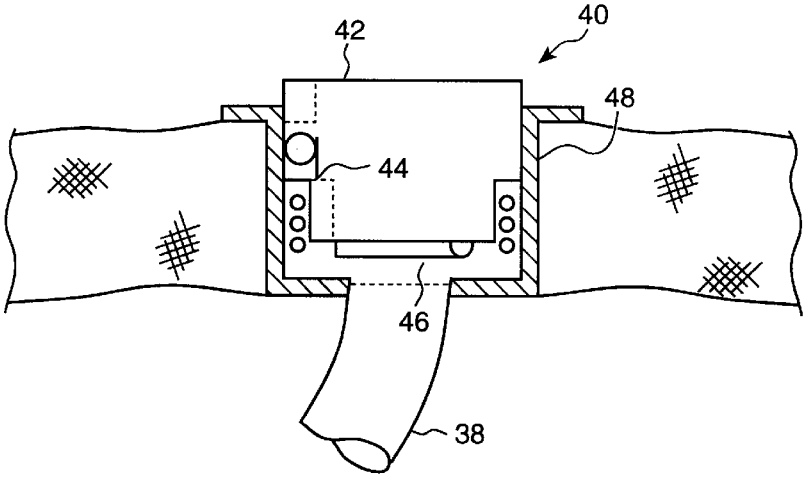
FIG. 4 is a sectional view of a valve useful with the invention.

The pouch 16 further includes a flexible duct 38 which establishes fluid communication between the interior of the pouch 16 and a valve member 40. The valve member 40 may take any one of a number of forms. For example, the valve 40 may be provided in the form of a collapsible nipple whereby the user will inflate the pouch 16 by manually opening the valve 40 to force air from his mouth into the pouch 16. Deflation of the pouch 16 may be accomplished by inserting a simple sleeve into the valve 40 to establish communication with the atmosphere. The valve 40 thus serves as a one-way check valve allowing ease of inflation of the pouch 16. Referring to FIG. 4, as another alternative, the valve 40 may be constituted by a check valve pump where the user will simply press on the valve 40 to move a piston 42 with two check valves, one a ball valve 44 and the other a flap valve 46 which will open sequentially to allow air to move into the space under the piston and then into the duct 38 and thence into the pouch 16. The piston 42 will be mounted in skirt 48. In such an arrangement, the user may supply more pressure into the chin strap pouch to tighten the fit of the helmet as a consequence of the greater inflation of the pouch 16. The valve 40 includes a removable closure member 50.

As will be apparent to those skilled in this art, the pouch 16 will also serve as a protection for the chin of the user during rough play. To improve the protection provided the chin area of a user, the pouch 16 preferably has an elongated shape in the form of an ovoid as shown in FIGS. 2 and 3.

Having described the invention, it will be apparent that various modifications may be made thereto without departing from the scope of this invention as defined in the appended claims.

What is claimed:

1. A retaining member to hold head wear on the head of a user comprising an elongated strip having opposite ends for attachment to the head wear, a chin engaging portion including an inflatable member, said portion being located intermediate said opposite ends, said inflatable member and said elongated strip are integrally formed of a resilient material, said inflatable member comprising a section of said material in the form of a pouch, said pouch having a wall portion, a valve being secured to extend through said wall portion for inflating and deflating said pouch, said valve including a piston communicating with a pair of check valves, said piston being disposed in a skirt, said skirt including a removable closure member, said piston being movable in said skirt when said closure member has been removed to open a passage through the check valves to allow inflation of said pouch.

2. The invention of claim 1 further including a helmet having depending ear covering portions, one of said opposite ends being secured to one of said ear covering portions, the other of said opposite ends of said strip having a first attachment member, the other of said ear covering portions having a second attachment member for cooperating with said first attachment member of said other end of said strip.

* * * * *